US008365980B2

(12) United States Patent
Wettlaufer et al.

(10) Patent No.: US 8,365,980 B2
(45) Date of Patent: Feb. 5, 2013

(54) FOOD CONTAINER

(75) Inventors: Bernhard Wettlaufer, Garmisch-Partenkirchen (DE); Stefan Lemke, Pogeez (DE)

(73) Assignee: PCO Group GmbH, Dassow (DE)

( * ) Notice: Subject to any disclaimer, the term of this patent is extended or adjusted under 35 U.S.C. 154(b) by 443 days.

(21) Appl. No.: 12/703,555

(22) Filed: Feb. 10, 2010

(65) Prior Publication Data

US 2011/0180593 A1 Jul. 28, 2011

(30) Foreign Application Priority Data

Jan. 28, 2010 (DE) ..... 10 2010 006 244

(51) Int. Cl.
*B65D 25/04* (2006.01)

(52) U.S. Cl. ..... 229/120.12; 206/561; 206/564; 206/565; 229/120.15

(58) Field of Classification Search ..... 229/120.12, 229/120.15, 902, 904, 906, 120.18; 206/216, 206/541, 784, 561–565
See application file for complete search history.

(56) References Cited

U.S. PATENT DOCUMENTS

| | | | | |
|---|---|---|---|---|
| 2,325,277 | A * | 7/1943 | Rothe et al. | 229/120.15 |
| 2,868,429 | A * | 1/1959 | Shanahan | 229/906 |
| 3,840,115 | A * | 10/1974 | Ladewig | 206/506 |
| 4,397,393 | A | 8/1983 | Pergande | |
| 5,630,544 | A | 5/1997 | Shane | |
| 5,720,429 | A | 2/1998 | Cordle | |
| 5,775,570 | A | 7/1998 | Kim | |
| 5,875,957 | A * | 3/1999 | Yocum | 229/906 |
| 5,950,912 | A * | 9/1999 | Economopoulos | 229/906 |
| 6,102,208 | A * | 8/2000 | Huang | 206/541 |
| 6,119,930 | A | 9/2000 | Lunstra et al. | |
| 6,152,362 | A | 11/2000 | Rosenfeld | |
| 6,216,946 | B1 | 4/2001 | Cai | |
| 6,349,874 | B1 | 2/2002 | Hill | |
| 6,439,452 | B1 | 8/2002 | Tsao | |
| 7,617,969 | B2 * | 11/2009 | Oliveira | 229/120.15 |
| 2001/0035454 | A1 | 11/2001 | Cai | |
| 2003/0141355 | A1 | 7/2003 | McLean | |

FOREIGN PATENT DOCUMENTS

| | | |
|---|---|---|
| DE | 1 951 962 | 12/1966 |
| DE | 7328525 | 4/1974 |
| DE | 8311539 | 8/1983 |
| DE | 8504384 | 5/1985 |
| DE | 8808196 | 10/1988 |
| DE | 196 02 707 | 7/1997 |
| DE | 200 02 348 | 6/2000 |

(Continued)

*Primary Examiner* — Gary Elkins
(74) *Attorney, Agent, or Firm* — Lempia Summerfield Katz LLC

(57) ABSTRACT

The invention is directed to a container for non-liquid food, such as for popcorn, potato chips or french fries, and has a bottom and an upright peripheral wall which together delineate a cavity for holding the food, as well as a pocket, which is formed from parts of the peripheral wall for holding an object that accompanies the food. In order to prevent an escape of the food located in the cavity and/or a contact of the object in the pocket with the food in the cavity, the invention provides that a lower end of the pocket is formed from a movable peripheral wall part which is delineated by two fold lines diverging upwards in a V shape and a punch line or cut joining the upper ends of the fold lines at a distance from an upper edge of the peripheral wall.

35 Claims, 9 Drawing Sheets

FOREIGN PATENT DOCUMENTS

| | | |
|---|---|---|
| EP | 1283 173 | 2/2003 |
| GB | 960546 | 6/1964 |
| GB | 2 199 224 | 7/1988 |
| WO | WO 2008/121756 | 10/2008 |

* cited by examiner

FOOD CONTAINER

RELATED APPLICATION DATA

This patent is related to and claims priority benefit of prior filed German national patent application no. 10 2010 006 244.8 filed on Jan. 28, 2010. The entire contents of this prior filed German patent application are hereby incorporated by reference herein.

BACKGROUND

1. Field of the Invention

The invention concerns a container for non-liquid food, especially for popcorn, potato chips or french fries, with a bottom and an upright peripheral wall, which together delineate a cavity for the food, as well as with a pocket formable or formed from parts of the peripheral wall for an object accompanying the food.

2. Description of Related Art

Food containers with an additional pocket are used, for example, in order to introduce french fries into the cavity and a packaged portion of ketchup in the pocket, as disclosed, for example, in U.S. Pat. No. 5,630,544, where the pocket for the ketchup is formed from a blank separate from a blank of the food container and which is glued onto the outside of the food container. However, this makes the manufacture of the food container more expensive.

Other food containers for similar purposes and with a similar design are disclosed in U.S. Pat. No. 6,439,452, U.S. Pat. No. 6,216,946, U.S. Pat. No. 6,152,362 as well as in WO-A 2008/121756.

Furthermore, from U.S. Pat. No. 5,775,570, a bucket-type food container of the type named at the outset is already known for popcorn, which comprises a holder formed from parts of the peripheral wall for a beverage container. There, the holder consists of several strip-like parts of the peripheral wall, which are parallel to the bottom of the container and which are separated from the neighboring parts of the peripheral wall by parallel punch lines or cuts and can be moved partly from a first position in which their surfaces are flush with the surfaces of the neighboring parts of the peripheral wall into a second position in which they protrude towards the inside into the cavity. Together with the peripheral wall parts remaining in the first position the peripheral wall parts moved into the second position form the holder which is open towards the top and into which the beverage container can be inserted from the top. In one embodiment, the beverage container is supported with its bottom on the upper edge of the lower strip-like peripheral wall part which remains in the first position. In this embodiment, however, a relatively large opening is formed at the level of the bottom of the beverage container in the peripheral wall, through which a part of the popcorn located in the cavity may fall out from the container when the cup is removed from the holder. When the cup is placed on a dirty surface, moreover, contaminants remain attached to the bottom of the beverage cup and when the beverage cup is inserted again into the holder, the popcorn in the container may be contaminated when the bottom of the cup comes into contact with the popcorn located in the cavity.

SUMMARY

Based on this, the aim of the invention is to improve a food container of the type mentioned at the outset, so that an escape of the food contained in the cavity and/or a contact of the object in the pocket with the food in the cavity can be prevented completely or at least to the maximum extent possible.

According to the invention, this task is solved by the fact that a lower end of the pocket is formed from a movable part of the peripheral wall that is delineated by two fold lines diverging upwards in a V-shape and a punch line or cut joining the upper ends of the fold line at a distance from the upper edge of the peripheral wall. The punch line or cut is expediently straight but it can also have a wavy or zigzag shape or can be curved towards the top or the bottom.

The movable part of the peripheral wall delineated by the two V-shaped diverging fold lines and the punch line or cut will also be referred to as the V-shaped peripheral wall part hereinafter.

Such a V-shaped peripheral wall part can be moved quickly and easily from a first position where its inner and outer surfaces are flush with the neighboring peripheral wall parts on the other side of the fold lines and the punch line or cut, to a second position, in which it projects beyond the neighboring peripheral wall parts toward the inside into the cavity and, together with at least one other peripheral wall part between the punch line or cut and the upper edge of the peripheral wall, delineates the pocket. Hereby, on the one hand, it forms a support for the object in the pocket and on the other hand, it separates the lower part of the pocket from the cavity with the food. During the movement of the V-shaped peripheral wall part between the two positions, the two fold lines each form a film hinge.

The object can be a food article, especially a packaged food article, which is supposed to be carried separately from the food in the cavity, for example, a sealed container with ketchup or mayonnaise, a snack, for example, a muesli or chocolate bar, or a sweet, for example, a chocolate egg in a foil wrap. However, the object can also be a ball or a toy figure or other gift article. Preferably, the object has a compact form, for example, being in the shape of a sphere, egg, cube or a rectangular solid.

With the peripheral wall part according to the invention, in difference to the holder known from U.S. Pat. No. 5,775,570, the pocket has no opening at the level of the lower end of the object, through which the food located in the cavity may fall out from the cavity and/or may come in contact with the object, but rather it is closed there so that the previously mentioned problems can be avoided to the maximum extent possible.

An advantageous embodiment provides that the V-shaped peripheral wall part is bi-stable, so that it moves automatically into one of the two positions mentioned above when is in a position between the two positions. In this way, when the food container is presented together with an object located in the pocket, the pocket cannot inadvertently close after the removal of the object. On the other hand, an undesired automatic opening of the pocket is avoided when the food container is presented without an object and therefore no pocket is to be formed because it is not needed.

In order to prevent an object located in the pocket from sliding out from the pocket to the outside or to prevent its falling out of the pocket toward the inside over the upper edge of the V-shaped peripheral wall projecting into the cavity, it is preferably provided that the fold lines diverge at an angle of less than 90 degrees and more than 45 degrees towards the top in a V shape. As a result of this, on the one hand, the angle of inclination of the peripheral wall part that projects into the cavity in the second position is not too large, while on the other hand, in this position the vertical distance between the upper edge of the peripheral wall and the lowermost point of the punch line or cut remains sufficiently small.

When the peripheral wall of the container according to another advantageous embodiment of the invention widens toward the top in the shape of an inverted truncated cone or pyramid, the upper boundary edge of the movable peripheral wall part can run in the first and in the second position of the peripheral wall part parallel to the upper edge of the peripheral wall.

In order to keep the object in the pocket, the punch line or cut at the upper boundary edge of the V-shaped peripheral wall part according to the invention is arranged at a distance from the upper edge of the peripheral wall of the container so that above the V-shaped peripheral wall part there is still at least one other peripheral wall part of the container which, together with the V-shaped peripheral wall part, delineates the pocket. Where there is only a single such peripheral wall part present, this peripheral wall part is separated by the punch line or cut from the movable V-shaped peripheral wall part, so that it does not move together with the V-shaped peripheral wall part toward the inside in the direction of the cavity or become deformed, but rather remains immovably in a position in which its inner and outer surfaces are flush with the surfaces of the parts of the peripheral wall that are neighboring it on the side. This immovable upper peripheral wall part is formed expediently in the form of a strip and extends from the upper boundary edge of the V-shaped peripheral wall part to the upper edge of the peripheral wall of the container.

However, an especially good holding of the object in the pocket can be ensured when, according to another preferred embodiment of the invention, above the V-shaped peripheral wall part not only one single peripheral wall part is present but two such parts, separated from on another, preferably in the form of strips. In this case, the upper one of the two peripheral wall parts as well as the V-shaped peripheral wall part can be moved from a first position in which its inner and outer surfaces are flush with the corresponding surfaces of laterally neighboring parts of the peripheral wall, into a second position in which it projects into the cavity and opposes tipping of the object in the pocket into the cavity. Expediently, the upper one of the two separate peripheral wall parts is also bi-stable.

In order to facilitate the movement of the upper one of the two peripheral wall parts between its first and second position, fold lines are arranged between the opposing ends of this peripheral wall part and the laterally adjoining peripheral wall parts, which, when the peripheral wall part moves from the first position to the second position and vice versa, also form film-hinges.

In order to make it possible to completely prevent any exit of the food located in the cavity and any contact of the object held by the pocket with the foods in the cavity, according to another preferred embodiment of the invention, the upper one of the two strip-like peripheral wall parts is adjoined by another peripheral wall part protruding beyond the edge of the peripheral wall. This peripheral wall part can be flipped down along a fold line parallel to the punch line or cut into the inside of the cavity and in this position it overlaps with its lower end the upper boundary edge of the movable V-shaped peripheral wall part, so that in the second position it closes a gap between the V-shaped peripheral wall part and the upper strip-like peripheral wall part. The protruding peripheral wall part preferably overlaps the V-shaped peripheral wall part on its outside, as a result of which the protruding peripheral wall part is held immovably.

The fold line, which separates the protruding peripheral wall part from the upper strip-like peripheral wall part is expediently aligned with the upper edge of the peripheral wall of the container so that above the pocket the latter can have the same height as along the rest of its circumference.

Another preferred embodiment of the invention provides that the food container is a folding box or foldable container in which the peripheral wall has a polygonal cross-section and has at least three corners. Preferably, one of the corners runs generally in the middle through the V-shaped peripheral wall part and forms another fold line which extends from a starting point of the two V-shaped diverging fold lines through the V-shaped peripheral wall part up to the punch line or cut. As an additional film-hinge, the middle fold-line facilitates movement of the V-shaped peripheral wall part between the two positions. In such a container, the bottom and the peripheral wall including the pocket are preferably made from a single blank made of cardboard which can be erected from a transporting position in which all parts of the bottom and the peripheral wall lie flat on top of one another, into a use position in which the peripheral wall stands up upright above the bottom.

However, alternatively, the container may also be a machine-made cup or bucket-shaped and preferably stackable container, in which the peripheral wall, for example, has a circular cross-section.

BRIEF DESCRIPTION OF THE DRAWINGS

Below the invention will be explained in more detail with the aid of some of the practical examples shown in the drawing.

DETAILED DESCRIPTION OF THE DISCLOSURE

Figure 1B:
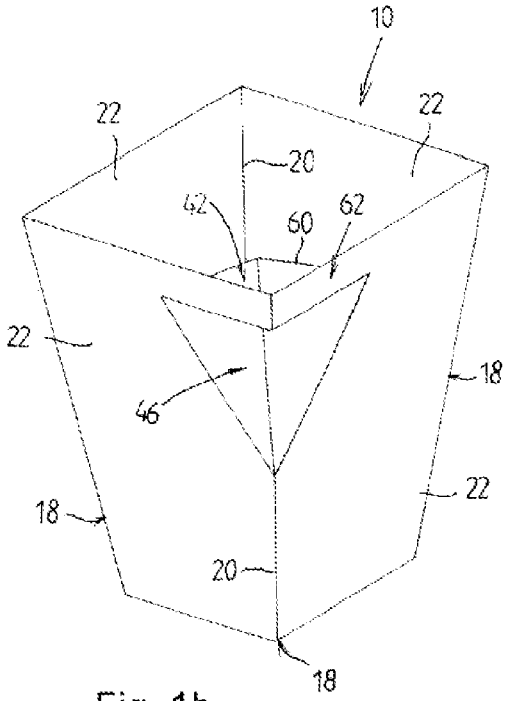
FIGS. 1*a*, 1*b* and 1*c* show perspective views of a food container according to the invention.

The containers 10 shown in the drawing serve for holding popcorn (not shown) which is poured loosely into a cavity 12 of container 10 that is open toward the top. The cavity 12 is delineated on the bottom by a bottom 14 and on the sides by an upright peripheral wall 16. The peripheral wall 16 and the bottom 14 are made of paper or cardboard in the case of all containers 10 and have a small wall thickness.

While the peripheral wall 16 of the container 10 shown in FIGS. 1*a* to 1*c*, 2*a* to 2*c* and 4*a* to 4*d*, made as a folding box, has a rectangular or square cross-section and always consists of four side walls 22 separated by fold lines 20 at the corners 18 of the peripheral wall 16, the peripheral wall 16 of the container 10 shown in FIGS. 6*a* to 7*d*, formed as a stackable cup, has a round cross-section, which, during manufacture of the container 10, is joined solidly to the bottom 14 and is glued in one position along a longitudinal seam (not shown).

The peripheral wall 16 has an upper edge 24 which surrounds an opening of the cavity 12 and runs parallel to the bottom 14 in all containers 10. But this does not necessarily have to be so.

Figure 3:
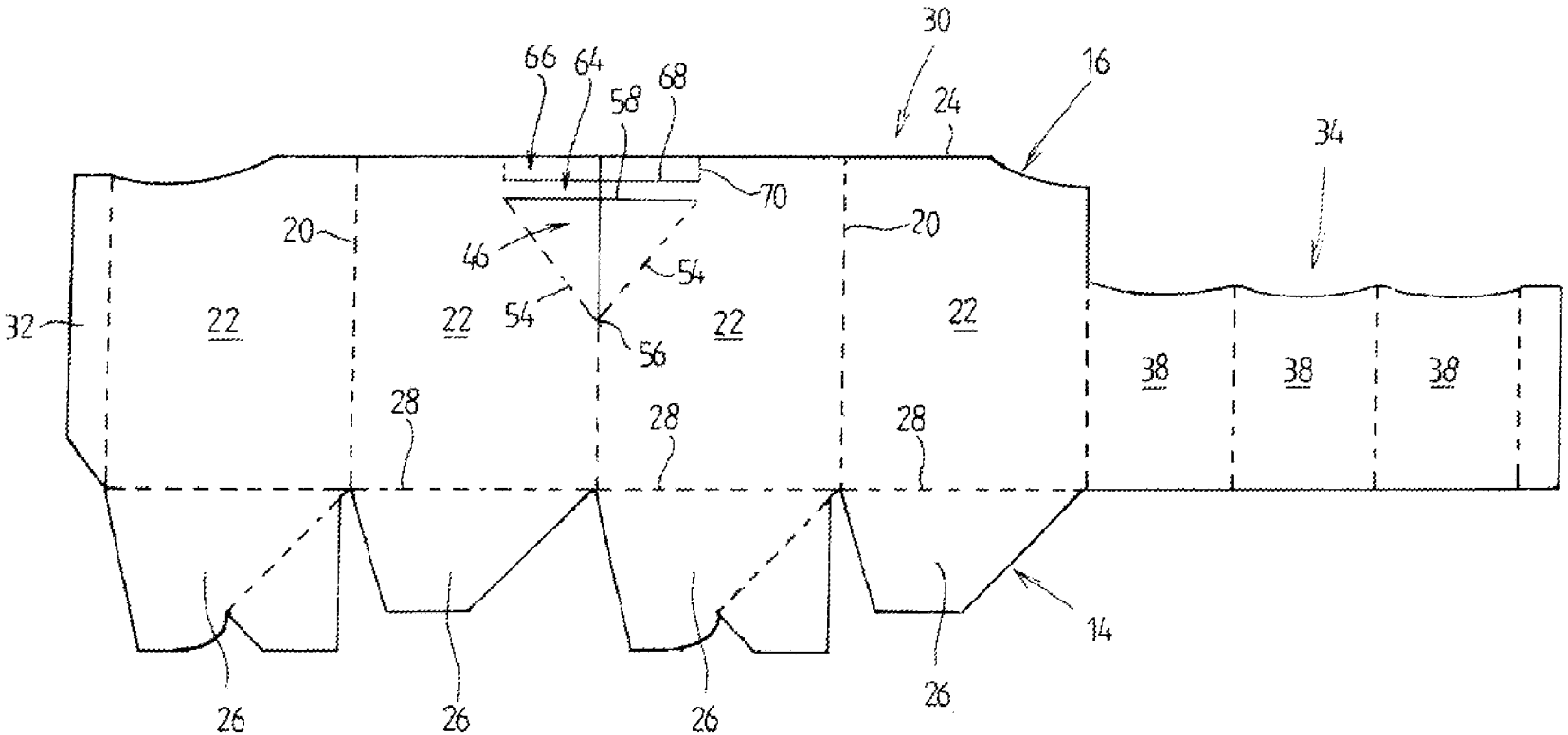
FIG. 3 shows a top view of a cardboard blank of the food container from FIGS. 2*a*, 2*b*, 2*c* and 2*d*.
Figure 4A:
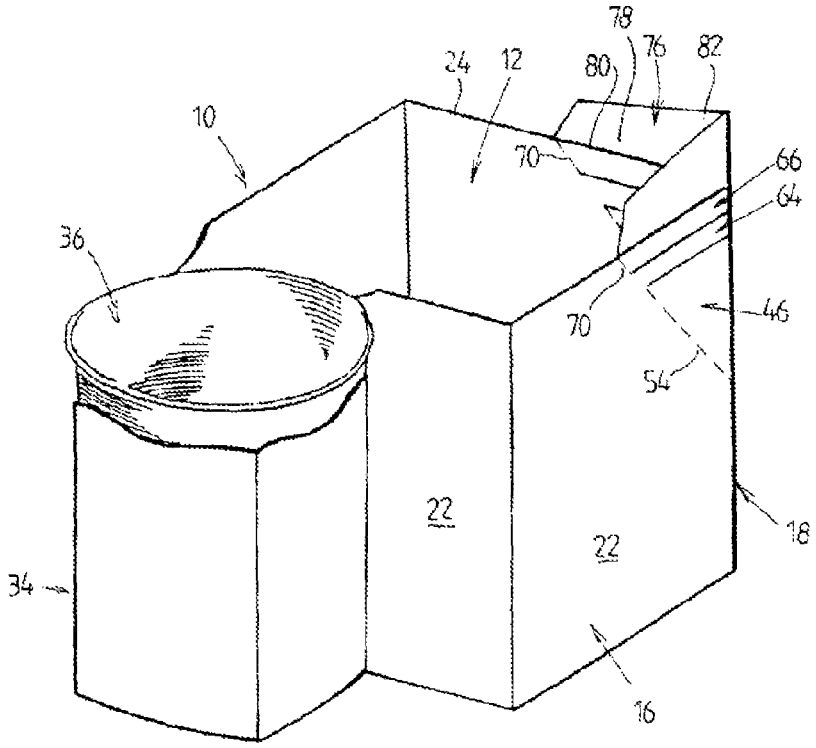
FIGS. 4*a*, 4*b*, 4*c* and 4*d* show perspective views of another food container according to the invention.
Figure 4B:
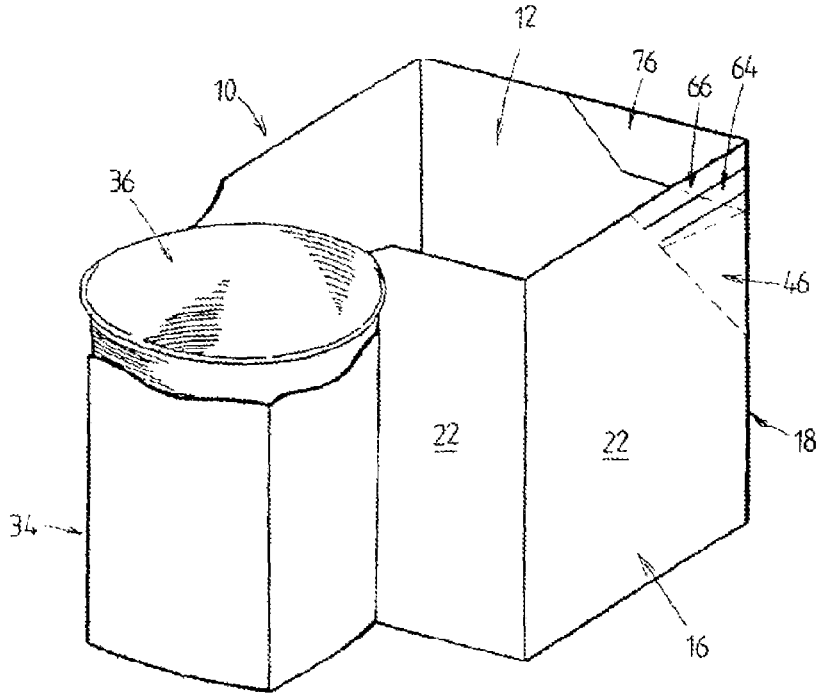
Figure 4C:
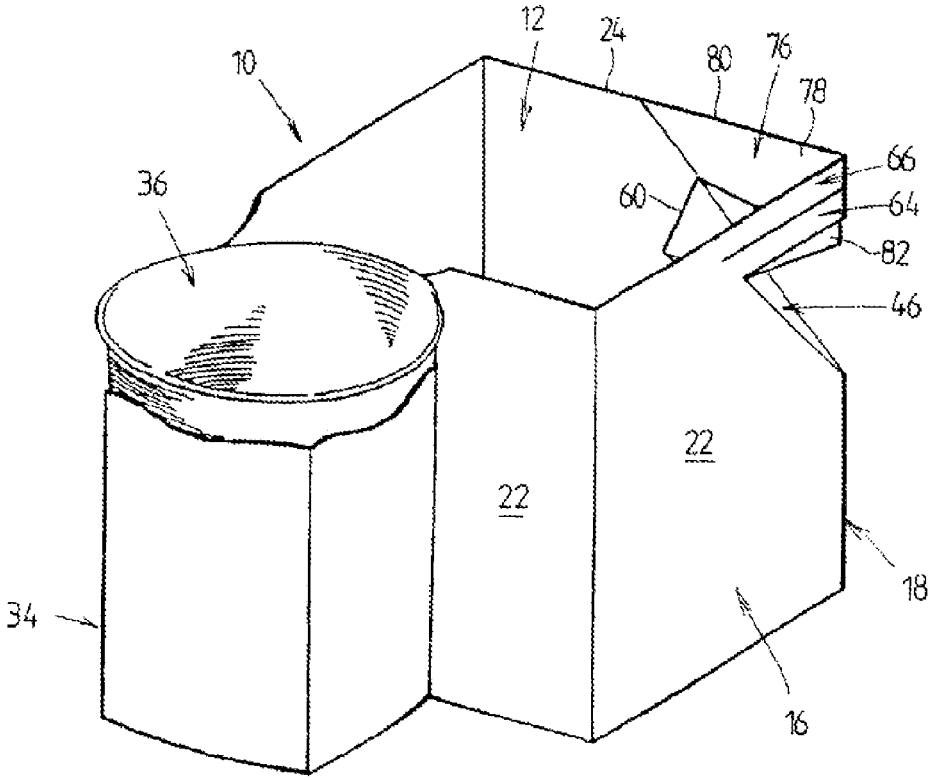
Figure 4D:
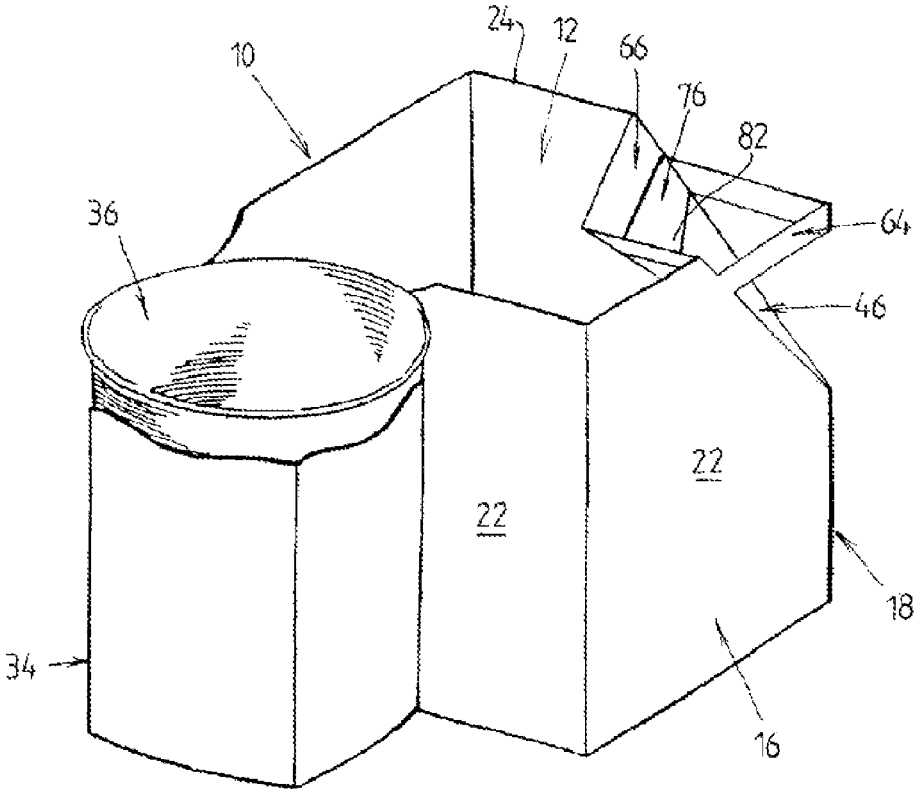
Figure 5:
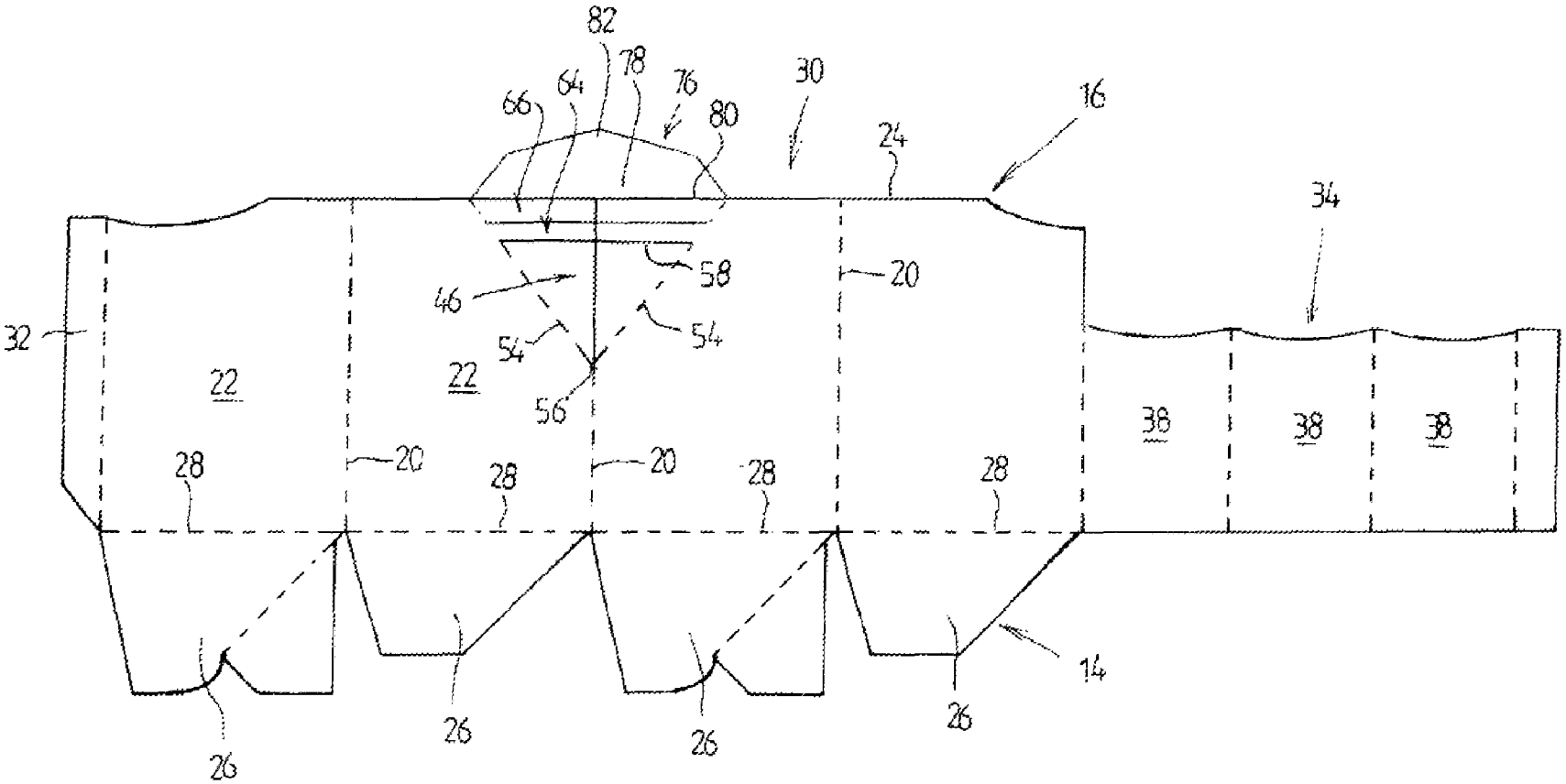
FIG. 5 shows a top view of a cardboard blank of the food container from FIGS. 4*a*, 4*b*, 4*c* and 4*d*.
Figure 6A:
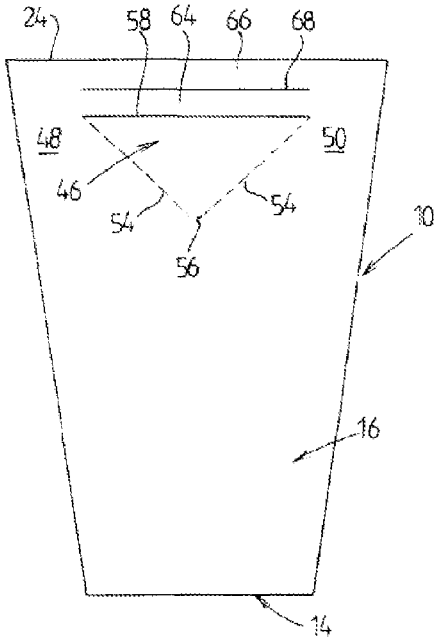
FIGS. 6*a*, 6*b*, 6*c*, and 6*d* show front views of another food container according to the invention.
Figure 6B:
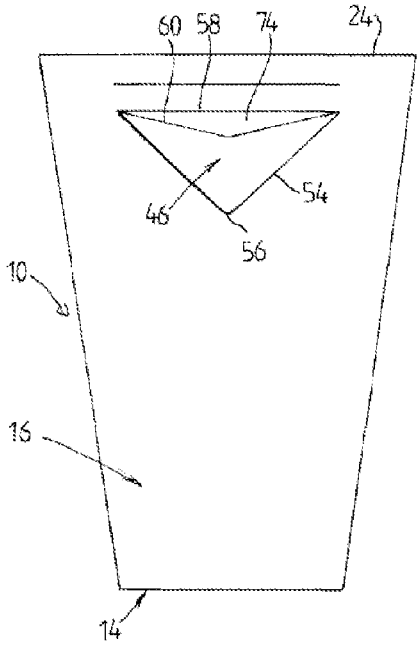
Figure 6C:
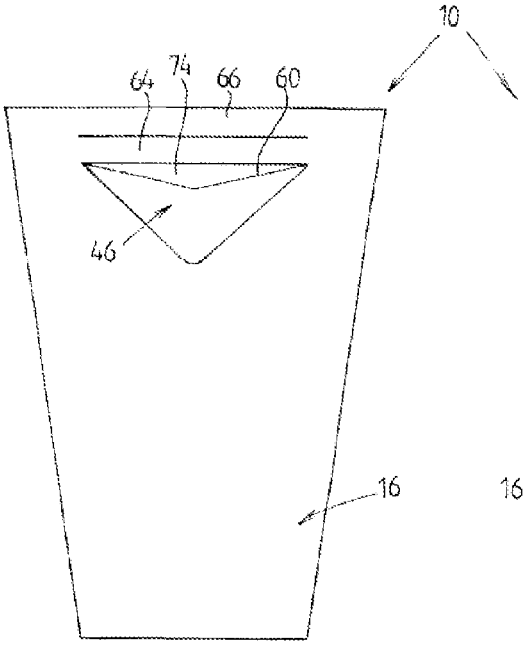
Figure 6D:
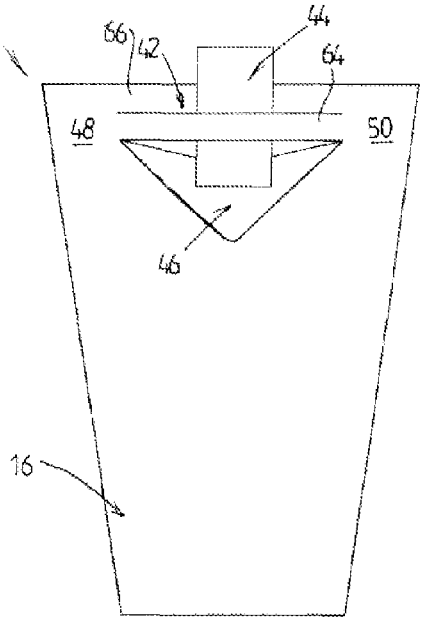

In the case of the containers 10 in FIGS. 1*a* to 1*c*, 2*a* to 2*b* and 4*a* to 4*d*, formed as folding boxes, the bottom 14 consists of four bottom parts 26, each of which is joined along a fold-line 28 to a neighboring side wall 22 as depicted by the blank 30 shown in FIGS. 3 and 5 for the container 10 in FIGS. 2*a* to 2*b* and 4*a* to 4*d*. After punching of the blank 30, the four bottom parts 26 are glued pair-wise to one another in the known manner and are flipped upwardly along the fold line 28 between the side walls 22 when the container 10 is folded together during manufacture, after the two opposite side walls 22 have been glued together with an adhesive tab 32. As a result of this, it is achieved in a known manner that the bottom 14 closes automatically when the folded container 10 with side walls 22 lying pair-wise above one another is expanded by pressing together two opposite corners 18.

The containers 10 in FIGS. 1*a* to 1*c* and 6*a* to 7*d* consist exclusively of the peripheral wall 16 and the bottom 14, while the containers 10 in FIGS. 2*a* to 2*d* and 4*a* to 4*d*, in addition to the peripheral wall 16 and the floor 14 also have a holder 34 for a drinking cup 36, which projects beyond the outside of one side wall 22 of container 10. The holder 34 consists essentially of three delineating walls 38, which are connected to one another and to the peripheral wall 16 of container 10 and surround a tubular cavity which is open toward the top and the bottom. The tubular cavity serves for holding the beverage cup 36, which is in the form of an inverted truncated cone and has at its upper end a larger cross-section in comparison to the opening cross-section of the cavity so that it cannot slip through the tubular cavity.

Figure 1A:
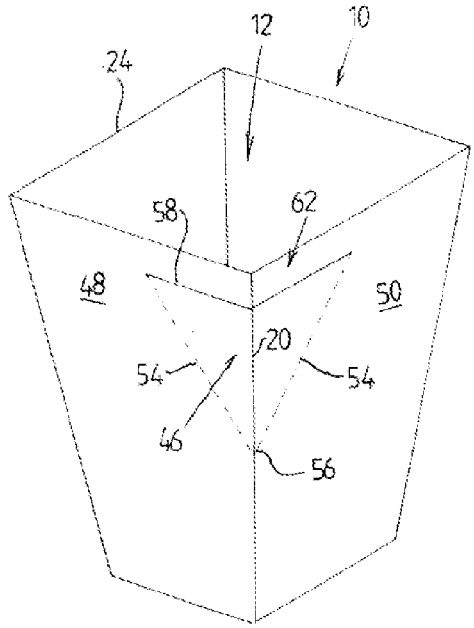
Figure 1C:
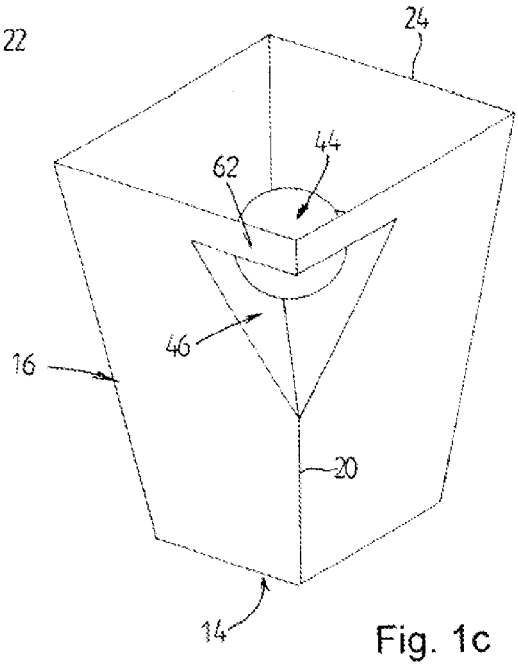

While the containers 10 in FIGS. 1*a* to 1*c* and in FIGS. 6*a* to 7*d* are in the form of an inverted truncated cone or pyramid, whereby the upright peripheral wall 16 is inclined with reference to the horizontal bottom 14 at an angle between 60 and 90 degrees, the containers 10 shown in FIGS. 2*a* to 2*b* and 4*a* to 4*d* without the holder 34 are in the shape of a cube or rectangular solid whereby the peripheral wall 16 is directed vertically to the bottom 14.

Moreover, all the containers 10 shown in the drawing are designed so that, when needed, in a simple manner a pocket 42 can be formed in the peripheral wall 16 for an object 44 to be carried along with the container 10, that accompanies the popcorn yet is separated from the popcorn. The object 44, which is shown schematically in the form of a sphere in FIG. 1*c*, in the form of an egg in FIGS. 2*d* and 4*d*, and in the form of a cylinder in FIGS. 6*d* and 7*d*, can be an arbitrary object which is to be sold together with the popcorn, such as a snack or sweet, for example, a packaged chocolate egg or it can also be an unpackaged or packaged toy or gift which is provided with the popcorn as a merchandising article.

The pocket 42 is integrated into the peripheral wall 16 of the container 10 and can be formed by moving at least one movable part 46 of the peripheral wall 16 from a first position, in which its inner and outer surfaces are flush with the surfaces of the neighboring peripheral wall parts 48, 50, as shown in FIGS. 1*a*, 2*a*, 4*a*, 6*a* and 7*a*, into a second position in which it projects into the inside of the cavity 12 and delineates a receiving opening 52 for the object 44 toward the bottom, as shown in FIGS. 1*b*, 2*b*, 3*c*, 6*b* and 7*b*.

The movable peripheral wall part 46 is delimited by a fold line 54 on both sides whereby the two fold lines 54 diverge from a starting point 56 in a V shape upwards. A punch line or cut 58 extends between the upper ends of the fold lines 54 at a distance from the upper edge 24 of the peripheral wall 16, and this runs in the containers 10 shown parallel to the bottom 14 and to the upper edge 24 of the peripheral wall 16, and, similarly to the two diverging fold lines 54, it is produced during the punching of the blank 30 for the container 10 (FIGS. 1 to 5) or for the peripheral wall 16 (FIGS. 6 and 7). The length of the punch line or cut 58 and its distance from the starting points 56 of the fold lines 54 are adjusted to one another in such a way that the angle enclosed by the fold lines 54 lies between 60 and 90 degrees. When the peripheral wall part 46 is moved into the second position, the two fold lines 54 form film-hinges, which makes it possible to move the peripheral wall part 46.

In the case of the containers 10 in FIGS. 1 to 5, the movable wall part 46 is arranged at one of the corners 18 of the container 10, whereby the fold line 20 running along the corner 18 runs through the starting point 56 and divides the movable peripheral wall part 46 as well as the punch line or cut 58 into two halves with minor image symmetry.

In the case of the container 10 in FIGS. 6 and 7, the movable peripheral wall part 46 on the other hand is arranged at any arbitrary position along the periphery and has no fold lines other than the fold lines 54.

Because of the kinked (FIGS. 1 to 5) or curved (FIGS. 6 and 7) cross-section of the peripheral wall 16 in the region of the movable peripheral wall part 46, the latter becomes bi-stable. This means that this peripheral wall part 46 moves from any intermediate position between the first position and the second position automatically into the first position or the second position depending on which of these positions lies closer to the intermediate position. As a result of this, the peripheral wall part 46 always assumes a defined position and can be moved from this position by a slight pressing force applied to the outside or inside into the other position, which simplifies the formation of the pocket 42.

In the case of containers 10 with a perpendicular peripheral wall 16 (FIGS. 2*a* to 2*d* and 4*a* to 4*d*), in the second position the upper boundary edge 60 adjoining the punch line or cut 58 of the movable peripheral wall part 46 is inclined toward the inside with respect to the upper edge 24 of the peripheral wall 16 whereby the larger the angle between the diverging folding lines 54 is the steeper the angle of inclination will be. In the case of containers 10 with an inclined peripheral wall in the form of a truncated pyramid (FIGS. 1*a* to 1*c*) or a truncated cone (FIGS. 6*a* to 7*d*) the upper boundary edge 60 of the peripheral wall part 46 has advantageously a smaller angle of inclination, or is parallel to the upper edge 24 when the angle of inclination of the folding line 20 in the second position of the peripheral wall part 46 corresponds to the angle of inclination of the peripheral wall 16.

In the case of the container 10 in FIGS. 1*a* to 1*c*, the movable peripheral wall part 46 is separated by the punch line or cut 58 from a single strip-like peripheral wall part 62, which extends above the movable peripheral wall part 46 from the punch line or cut 58 up to the upper edge 24 of the peripheral wall 16. When the movable peripheral wall part 46 is moved toward the inside into the second position, in which it projects into the cavity 12, as shown in FIG. 1*b*, the strip-like peripheral wall part 62 remains in its original position in which its inner and outer surfaces are flush with the inner or outer surfaces of the laterally adjoining peripheral wall parts 48, 50. In this position, the strip-like peripheral wall part 62 holds the object 44 located in the pocket 42 and supported at the bottom on the movable peripheral wall 46 in a fixed position and prevents it from slipping out downward along the inclined peripheral wall part 46 and out from the pocket 42, as shown in FIG. 1*c*.

Figure 2A:
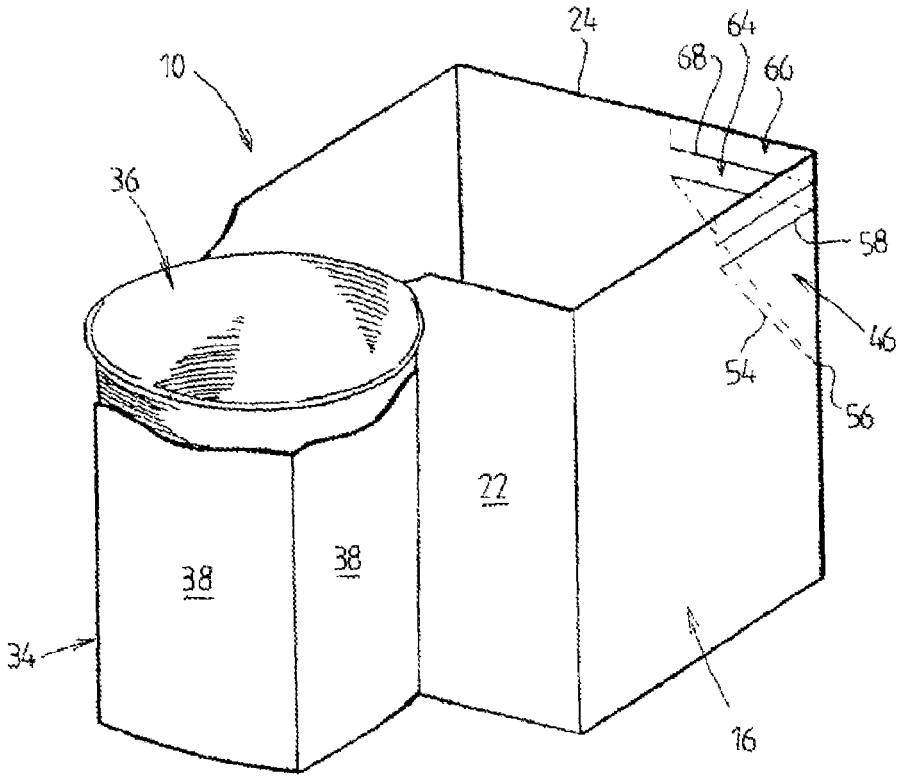
FIGS. 2*a*, 2*b*, 2*c* and 2*d* show perspective views of another food container according to the invention.
Figure 2B:
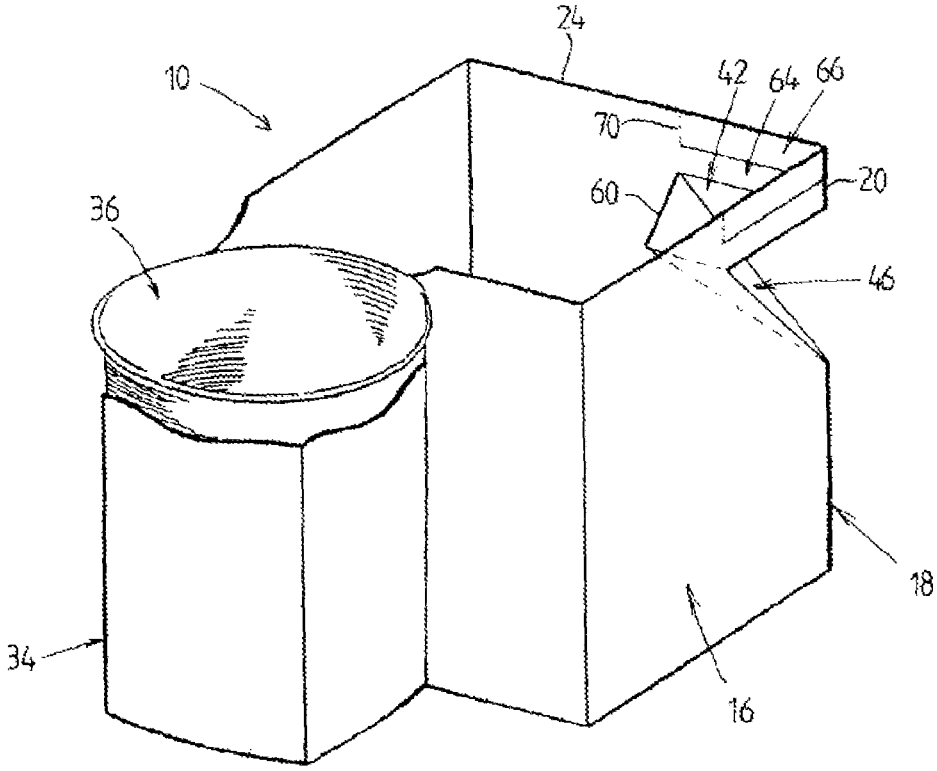
Figure 2C:
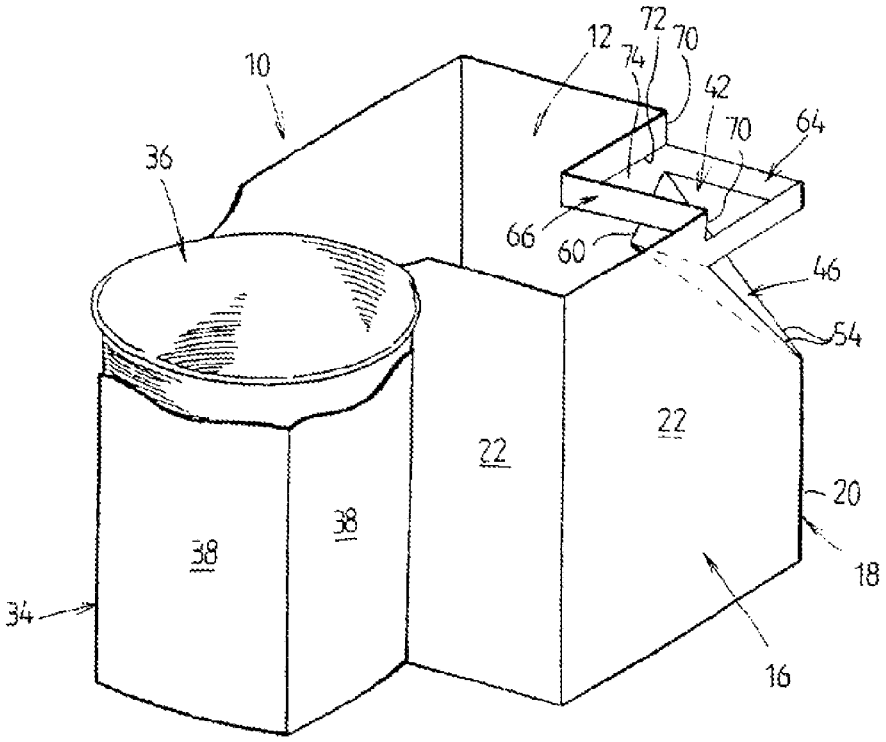
Figure 2D:
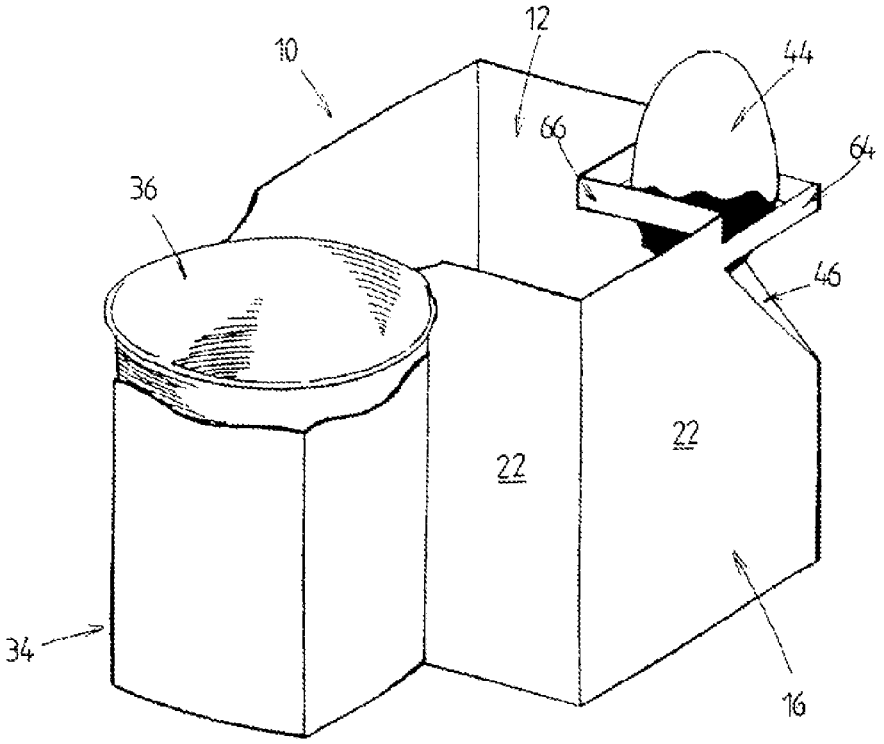
Figure 7A:
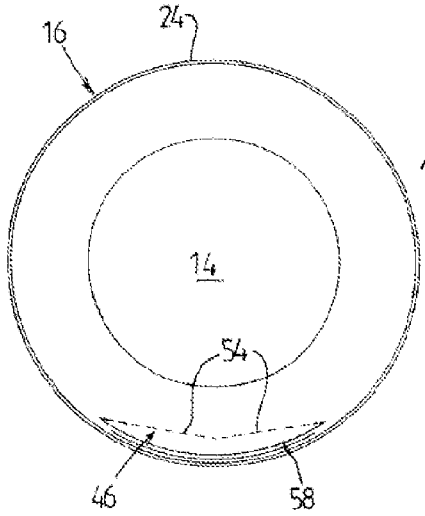
FIGS. 7*a*, 7*b*, 7*c* and 7*d* show top views of the food container of FIGS. 6*a*, 6*b*, 6*c* and 6*d*.
Figure 7B:
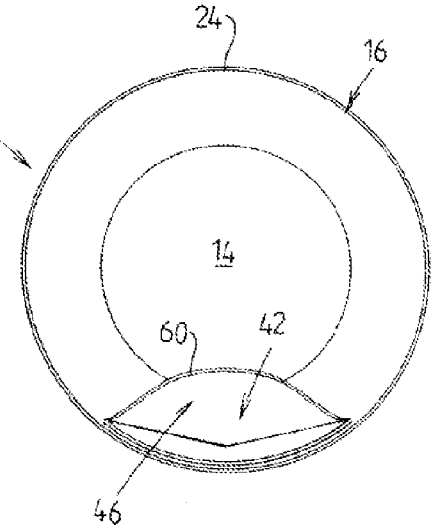
Figure 7C:
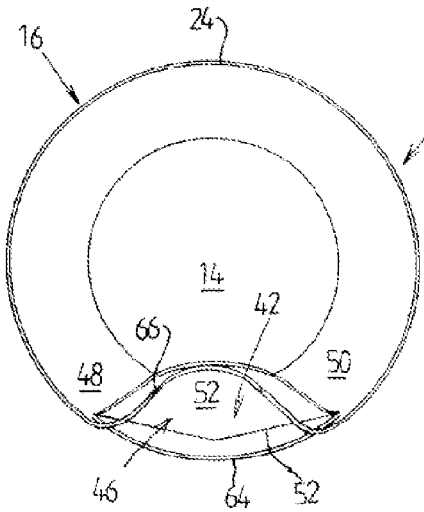
Figure 7D:
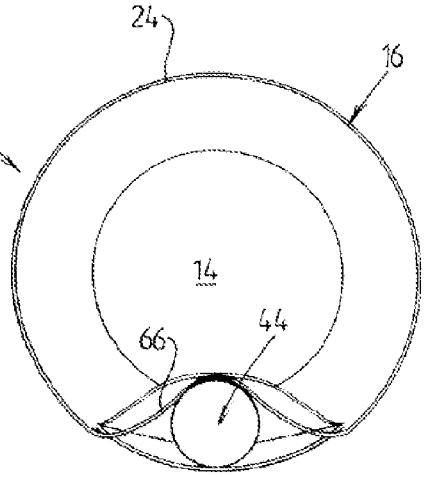

In the case of the containers 10 in the other Figures, above the movable peripheral wall part 46, the peripheral wall 16 has two strip-like peripheral wall parts 64, 66 generally parallel to the upper edge 24 of the peripheral wall, and these are separated from one another by an additional punch line or cut 68, which is parallel to the upper edge 24 and to the punch line or cut 58, and both of these have about the same width. In the case of containers 10 with a polygonal cross-section, the upper part 66 of these two peripheral wall parts 64, 66 is separated on its opposite ends from the adjoining peripheral wall parts 48, 50 by fold lines 70 which can be perpendicular to the upper edge 24 (FIGS. 2*a* to 2*d*) or parallel to the fold lines 54 (FIGS. 4*a* to 4*d*). The upper strip-like peripheral wall part 66, like the peripheral wall part 46, can be moved from a first position in which its inner and outer surfaces are flush with the inner and outer surfaces of the adjoining peripheral wall parts 48, 50, into a second position, in which it projects into the cavity 12 above and at a distance from the upper boundary edge 60 of the peripheral wall part 46, as shown in FIGS. 2*c*, 4*d* and 7*c*. In this position, the peripheral wall part 66 prevents the object 44 located in the pocket 42 from falling over the boundary edge 66 of the inclined peripheral wall part 46 into the cavity 12.

In the case of containers where the peripheral wall 16 extends towards the top in the shape of a truncated pyramid or in the shape of a truncated cone, as in the case of the container 10 in FIGS. 6*a* to 7*d*, the upper boundary edge of the strip-like peripheral wall part 66 may lie both in the first and in the second position of the peripheral wall part 66 in a plane which is defined by the upper edge 24 of the peripheral wall.

Since the lower one 64 of the two strip-like peripheral wall parts 64, 66 remains in the original position in which its inner and outer surfaces are flush with the inner and outer surfaces of the laterally adjoining peripheral wall parts 48, 50, in the case of the containers 10 in FIGS. 2*a* to 2*d* and 6*a* to 7*d*, when the two peripheral wall parts 46, 66 are located in the second position, a gap 74 opens between the upper boundary edge 60 of the V-shaped peripheral wall part 46 and the lower boundary edge 72 of the upper strip-like peripheral wall part 66 adjoining the punch line or cut 68, as it is shown best in FIG. 2*c*. Since this gap 74 is located near the upper edge 24 of the peripheral wall 16, it is relatively narrow and, moreover, it is partially closed by the object 44 introduced into the pocket 42, so that normally no popcorn will fall to the outside through the gap 74.

In order to completely ensure that no popcorn will fall outside through the gap 74, and at the same time to prevent any contact between the popcorn and the object 44 in the pocket 42, the container 10 shown in FIGS. 4*a* to 4*d* has an additional peripheral wall part 76 adjoining the side of the upper strip-like peripheral wall part 66 which is opposite to the punch line or cut 68. As shown in FIGS. 4*a* and 5, the peripheral wall part 76 in the blank 30 used for the manufacture of the container 10, protrudes from the upper edge 24 of the peripheral wall 16 beyond the upper edge of the other strip-like peripheral wall part 66. The peripheral wall part 76 that narrows away from the edge 24 consists of a wider section 78 that adjoins to the fold line 80 which is aligned with the upper edge 24 of the peripheral wall 16 and is arranged between the peripheral wall parts 66, 76, and a section 82 that ends in a point. The form of the peripheral wall part 76 is adjusted so that it completely closes the gap 72 in the second position of the strip-like peripheral wall part 66 when the latter is flipped inwardly and downwardly, lying against the inside of the peripheral wall part 66 with its section 78 adjoining the fold line 80 and projecting with its end section 82 beyond the upper boundary edge 60 of the peripheral wall part 46, whereby it overlaps the latter on the outside as shown in FIG. 4*d*.

What is claimed is:

1. A container for non-liquid food, especially for popcorn, potato chips or french fries, the container comprising:

a bottom and an upright peripheral wall which together delineate a cavity for holding the food; and a pocket formed or formable from parts of the peripheral wall for holding an object accompanying the food, wherein a lower end of the pocket is formed from a movable peripheral wall part which is delineated by two fold lines diverging upwards in a V shape and a punch line or cut joining the upper ends of the two fold lines at a distance from an upper edge of the peripheral wall, wherein the movable peripheral wall part can be moved from a first position, in which its surfaces are flush with surfaces of neighboring wall parts on the other side of the fold lines and of the punch line or cut, into a second position, in which the movable peripheral wall part projects into the inside of the cavity and forms a support for the object in the pocket, and wherein a further movable peripheral wall part is arranged between the punch line or cut and the upper edge of the peripheral wall, which, to form the pocket, can be moved from a first position in which its surfaces are flush with the surfaces of neighboring wall parts into a second position in which it projects into the inside of the cavity.

2. A container according to claim 1, wherein the movable peripheral wall part is bi-stable, so that it moves automatically into the first or second position when it is located between the two positions.

3. A container according to claim 1, wherein the two fold lines diverge upward in a V shape at an angle of more than 45 degrees and less than 90 degrees.

4. A container according to claim 1, wherein an immovable peripheral wall part is arranged between the punch line or cut and the upper edge of the peripheral wall, the inner and outer surfaces of which are flush with the surfaces of neighboring wall parts when the movable peripheral wall part has been moved into the second position to form the pocket.

5. A container according to claim 4, wherein the peripheral wall part is in the form of a strip.

6. A container according to claim 1, wherein the peripheral wall part is in the form of a strip.

7. A container according to claim 1, wherein a protruding peripheral wall part adjoins the further movable peripheral wall part and can be flipped into the inside of the cavity such that a free end of the protruding peripheral wall part overlaps an upper boundary edge of the movable peripheral wall part.

8. A container according to claim 5, wherein a protruding peripheral wall part adjoins the further movable peripheral wall part and can be flipped into the inside of the cavity such that a free end of the protruding peripheral wall part overlaps an upper boundary edge of the movable peripheral wall part.

9. A container according to claim 6, wherein a protruding peripheral wall part adjoins the further movable peripheral wall part and can be flipped into the inside of the cavity such that a free end of the protruding peripheral wall part overlaps an upper boundary edge of the movable peripheral wall part.

10. A container according to claim 7, wherein the protruding peripheral wall part overlaps the upper boundary edge of the peripheral wall part on the outside of the peripheral wall part.

11. A container according to claim 8, wherein the protruding peripheral wall part overlaps the upper boundary edge of the peripheral wall part on the outside of the peripheral wall part.

12. A container according to claim 7, wherein the protruding peripheral wall part is joined to the peripheral wall part along a fold line which is aligned with the upper edge of the peripheral wall.

13. A container according to claim 8, wherein the protruding peripheral wall part is joined to the peripheral wall part along a fold line which is aligned with the upper edge of the peripheral wall.

14. A container according to claim 1, wherein a further fold line is arranged between the two diverging fold lines.

15. A container according to claim 1, wherein the peripheral wall has a polygonal cross-section and at least three corners, one of which divides the movable peripheral wall part between the punch line or cut and the starting point of the fold lines into two parts.

16. A container according to claim 1, wherein the bottom and the peripheral wall consist of a single folded and glued blank.

17. A container according to claim 1, wherein the peripheral wall has a circular or oval cross-section.

18. A container according to claim 1, wherein the peripheral wall widens toward the top in the shape of a truncated cone or pyramid and wherein an upper boundary edge of the movable peripheral wall part and/or of the further movable peripheral wall part is generally parallel to the upper edge of the peripheral wall.

19. A container for non-liquid food, especially for popcorn, potato chips or french fries, the container comprising:

a bottom and an upright peripheral wall which together delineate a cavity for holding the food; and a pocket formed or formable from parts of the peripheral wall for holding an object accompanying the food, wherein a lower end of the pocket is formed from a movable peripheral wall part which is delineated by two fold lines diverging upwards in a V shape and a punch line or cut joining the upper ends of the two fold lines at a distance from an upper edge of the peripheral wall, wherein the two fold lines diverge upward in a V shape at an angle of more than 45 degrees and less than 90 degrees, and wherein a further movable peripheral wall part is arranged between the punch line or cut and the upper edge of the peripheral wall, which, to form the pocket, can be moved from a first position in which its surfaces are flush with the surfaces of neighboring wall parts into a second position in which it projects into the inside of the cavity.

20. A container according to claim 19, wherein an immovable peripheral wall part is arranged between the punch line or cut and the upper edge of the peripheral wall, the inner and outer surfaces of which are flush with the surfaces of neighboring wall parts when the movable peripheral wall part has been moved into the second position to form the pocket.

21. A container according to claim 20, wherein the peripheral wall part is in the form of a strip.

22. A container according to claim 19, wherein the peripheral wall part is in the form of a strip.

23. A container according to claim 19, wherein a protruding peripheral wall part adjoins the further movable peripheral wall part and can be flipped into the inside of the cavity such that a free end of the protruding peripheral wall part overlaps an upper boundary edge of the movable peripheral wall part.

24. A container according to claim 21, wherein a protruding peripheral wall part adjoins the further movable peripheral wall part and can be flipped into the inside of the cavity such that a free end of the protruding peripheral wall part overlaps an upper boundary edge of the movable peripheral wall part.

25. A container according to claim 22, wherein a protruding peripheral wall part adjoins the further movable peripheral wall part and can be flipped into the inside of the cavity such that a free end of the protruding peripheral wall part overlaps an upper boundary edge of the movable peripheral wall part.

26. A container according to claim 23, wherein the protruding peripheral wall part overlaps the upper boundary edge of the peripheral wall part on the outside of the peripheral wall part.

27. A container according to claim 24, wherein the protruding peripheral wall part overlaps the upper boundary edge of the peripheral wall part on the outside of the peripheral wall part.

28. A container according to claim 23, wherein the protruding peripheral wall part is joined to the peripheral wall part along a fold line which is aligned with the upper edge of the peripheral wall.

29. A container according to claim 24, wherein the protruding peripheral wall part is joined to the peripheral wall part along a fold line which is aligned with the upper edge of the peripheral wall.

30. A container according to claim 19, wherein the movable peripheral wall part is bi-stable, so that it moves automatically into the first or second position when it is located between the two positions.

31. A container according to claim 19, wherein a further fold line is arranged between the two diverging fold lines.

32. A container according to claim 19, wherein the peripheral wall has a polygonal cross-section and at least three corners, one of which divides the movable peripheral wall part between the punch line or cut and the starting point of the fold lines into two parts.

33. A container according to claim 19, wherein the bottom and the peripheral wall consist of a single folded and glued blank.

34. A container according to claim 19, wherein the peripheral wall has a circular or oval cross-section.

35. A container according to claim 19, wherein the peripheral wall widens toward the top in the shape of a truncated cone or pyramid and wherein an upper boundary edge of the movable peripheral wall part and/or of the further movable peripheral wall part is generally parallel to the upper edge of the peripheral wall.

* * * * *